United States Patent [19]

Ireland

[11] 3,933,009

[45] Jan. 20, 1976

[54] EARRING HAVING PIVOTED ONE-PIECE EARWIRE WITH MEANS FOR LIMITING LATERAL SHIFT

[75] Inventor: Thomas R. Ireland, Cumberland, R.I.

[73] Assignee: Hallmark Findings Inc., Warwick, R.I.

[22] Filed: Aug. 9, 1974

[21] Appl. No.: 496,207

[52] U.S. Cl. ..... 63/12; 24/232

[51] Int. Cl.[2] ..... A44C 7/00

[58] Field of Search ..... 63/12, 13, 20, 14 C; 24/232, 232 G, 241 D, 248 E, 248 SL; 70/459

[56] References Cited

UNITED STATES PATENTS

| | | | |
|---|---|---|---|
| 240,591 | 4/1881 | Hessels | 63/13 |
| 298,762 | 5/1884 | Mackinney | 63/13 |
| 1,239,746 | 9/1917 | Tobie | 24/248 SL |
| 2,619,698 | 12/1952 | Elsner | 24/232 X |
| 2,931,195 | 4/1960 | La Flamme et al. | 63/12 |
| 3,430,470 | 3/1969 | Muckleston | 24/232 X |
| 3,575,013 | 4/1971 | Chernow et al. | 63/12 |
| R22,729 | 3/1946 | Hubbell | 63/14 C |

*Primary Examiner*—F. Barry Shay
*Attorney, Agent, or Firm*—Salter & Michaelson

[57] ABSTRACT

A pierced earring construction including a hoop-type earring member having spaced free ends and an earwire that is pivotally mounted on one of the free ends, the earwire including a pivot portion that is formed as an integral part thereof and that extends through the free end on which the earwire is mounted for pivotally locating the earwire on said earring member.

2 Claims, 5 Drawing Figures

EARRING HAVING PIVOTED ONE-PIECE EARWIRE WITH MEANS FOR LIMITING LATERAL SHIFT

BACKGROUND OF THE INVENTION

The present invention relates to pierced earrings and to the manner of securing an earwire to the body portion of the pierced earring.

Generally, the pierced earring construction as embodied in the present invention relates to hoop-type earrings which are formed in a generally circular configuration and that include free ends that are spaced from each other. An earwire is connected to one of the free ends and bridges the space between the free ends for mounting the pierced earring on the ear of a wearer.

Prior to the instant invention, the earwire of the hoop-type earring was usually secured in pivotal relation on a free end thereof by the forming of a loop on the pivot end of the earwire, the loop receiving a pivot pin that extended through the body portion of the earring at the free end thereof. Thus, in this prior known hoop-type earring, the loop of the earwire was pivotally mounted on a pivot pin; and, although the earwire in such prior known constructions was pivotal in the manner required, it was also usually loosely fitted, which resulted in undue lateral shifting thereof. This not only caused difficulty in locating the free end of the earwire in place during mounting of the earring on the ear of the wearer, but oftentimes the undue lateral shifting of the earwire resulted in dislodgment or breaking of the earwire from the pivot pin.

In some of the less expensive types of hoop earrings, a slot was formed in a free end of the hoop through which the pivot end of the earwire extended. Here again it was difficult to prevent lateral shifting of the earwire, which rendered it more difficult to attach the earwire in place during the mounting thereof on the wearer's ear. Other slotting techniques have also been utilized for hoop-type earrings of the piercing variety; and in all such earrings, it was difficult to prevent lateral shifting of the earwire during the mounting thereof on the wearer's ear. Frequently, undue lateral shifting of the earwire with respect to the body portion to which it was pivotally connected caused the earwire to become disconnected from the pivot position thereof.

SUMMARY OF THE INVENTION

The present invention relates to a pierced earring construction and comprises an earring member that includes a body portion that terminates in spaced free ends. A laterally extending opening is formed in the body portion adjacent to one of the free ends thereof, and an earwire is provided that includes a pivot portion formed as an integral part thereof. The pivot portion is mounted in the opening in the body portion for pivotally locating the earwire on the body portion. A piercing portion of the earwire that is joined to the pivotal portion thereof bridges the space between the free ends for mounting the earring member on an ear of a wearer. Since the pivot portion as joined to the body portion of the earring member includes legs that are located in close proximity to the earring body portion on opposite sides thereof, lateral shifting of the earwire during the pivotal movement thereof is prevented. Further, the conventional slots and pins normally associated with the prior known hoop-type earring constructions are avoided, and the mounting of the earwire is simply accomplished by inserting a pivot leg thereof through an opening in the earring body portion and thereafter bending another leg of the pivot portion to a closed position thereof.

Accordingly, it is an object of the present invention to provide a pierced earring construction that includes an earwire having a pivot portion that is joined to a body portion of the earring and that defines the pivot connection for the earwire.

Another object is to provide a pierced earring construction that includes an earwire that is pivotally mounted on a body portion and that is formed with legs that are joined to a pivot leg, the pivot leg extending through an opening in the body portion of the earring member and defining the pivot about which the earwire is rotated relative to the earring body portion.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
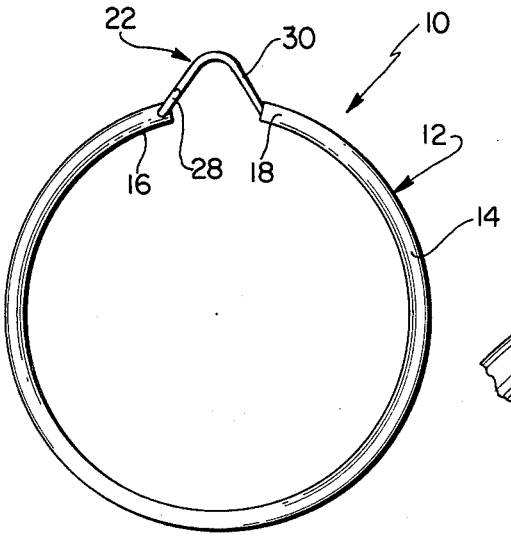
FIG. 1 is an elevational view of the pierced earring construction embodied in the present invention.

Referring now to the drawing and particularly to FIG. 1, the pierced earring construction embodied in the present invention is illustrated and is generally indicated at 10. The earring construction 10 includes an earring member generally indicated at 12 that is defined by a tubular body portion 14 formed in a hoop configuration and that terminates in free ends 16 and 18 that are located in spaced apart relation. As illustrated, the invention has particular application to the hoop-type of pierced earring construction, although the concept of the invention is also applicable to pierced earrings having various geometric configurations.

Figure 2:
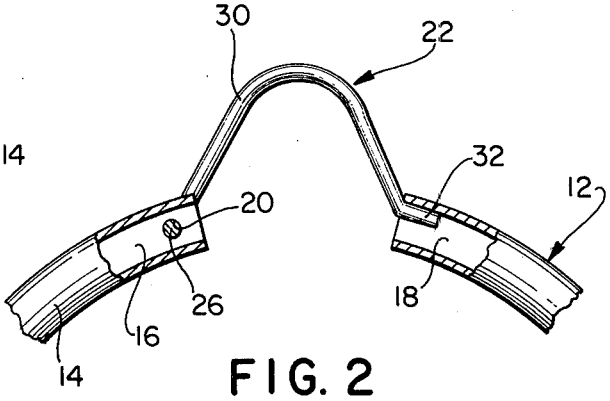
FIG. 2 is an enlarged elevational view showing the earwire as mounted in the closed position on the body portion of the earring construction, portions of the earring construction being shown in section.

As shown in FIG. 2, a transversely extending opening 20 is formed in the free end 16 of the body portion 14 adjacent to the end thereof. The body portion 14 of the earring member 12 is formed in a tubular configuration which defines a recess or opening in the free end 18 into which an end finger of an earwire generally indicated at 22 is received, when the earwire 22 is located in the closed or mounting position thereof. As described, the body portion 14 of the earring member 12 is tubular in construction; although, it is contemplated that the body portion 14 be cast in a solid construction and the free ends thereof hollowed out to form recesses for mounting the earwire 22 thereon.

Figure 3:
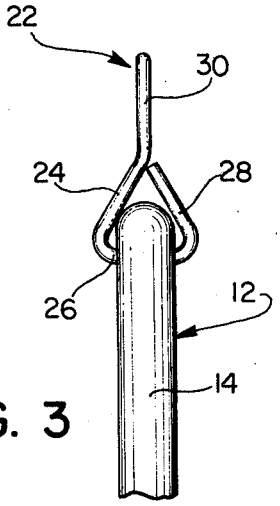
FIG. 3 is an end elevational view of the earwire as mounted on the body portion of the earring construction.
Figure 4:
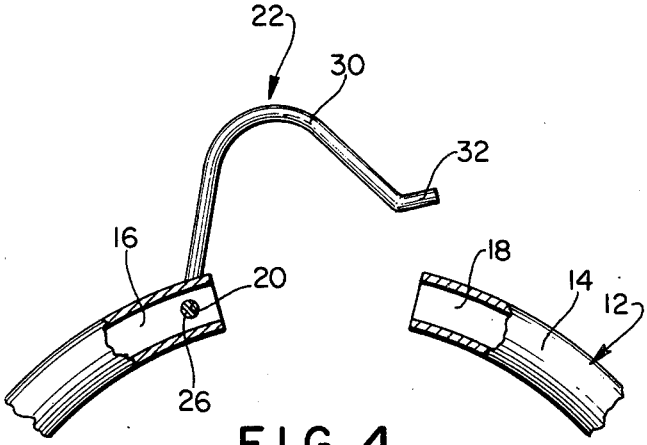
FIG. 4 is a view similar to FIG. 2 and showing the open position of the earwire.
Figure 5:
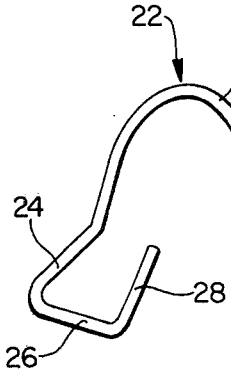
FIG. 5 is an elevational view of the earwire embodied in the present invention prior to the mounting thereof on the body portion of the earring construction.

Referring now to FIGS. 3 and 5, the earwire 22 is shown in detail and as illustrated includes a pivot portion defined by a locking leg 24 joined to a pivot leg 26 and a third leg 28 that is also joined to the pivot leg 26. The locking leg 24 is integrally joined to a curved piercing portion 30 of the earwire, the piercing portion 30 terminating in a locking finger 32.

In the assembly of the earwire 22 to the body portion 14 of the earring member 12, the earwire 22 is preformed in the manner as illustrated in FIG. 5, wherein the leg 28 of the pivot portion thereof is spaced from the leg 24 to provide for threading of the leg 28 and the pivot leg 26 through the opening 20 as formed in the free end 16 of the earring member 12. When the leg 28 projects beyond the opening 20 so as to be received on the side of the body portion 14 opposite to that of the leg 24, the pivot leg 26 is received in the opening 20 and defines the pivot for the earwire 22. With the pivot leg 26 mounted in the opening 20, the leg 28 is then bent to the closed position as illustrated in FIG. 3, thereby forming a generally triangular configuration with the leg 24 and pivot leg 26. With the earwire located in the assembled position on the body portion 14 of the earring member 12 as illustrated in FIG. 3, the piercing portion 30 is disposed in generally aligned position with respect to the body portion 14. Contrary to the prior known pierced earring constructions, the earwire 22 is pivotal with respect to the body portion 12 in such a manner as to easily provide for entry of the locking finger 32 of the earwire into the opening as formed in the free end 18 of the earring member. Thus, it is seen that the legs 24 and 28 of the pivot portion of the earwire prevent undue lateral or transverse shifting movement of the earwire 22 during pivotal movement thereof, and the finger 32 is easily inserted into the opening as formed in the free end 18 of the earring member to lock the earwire in the closed position. Further, the assembly of the earwire 22 onto the body portion 14 of the earring member 12 is simply accomplished by threading the leg 28 and pivot leg 26 through the opening 20 in the free end 16. The earwire 22 is mounted in position for pivotal movement by closing of the leg 28 to the position illustrated in FIG. 3.

It is seen that a separate pintle is not required by the subject invention for mounting the earwire in place, and it is further seen that slotting of the free end 16 of the body portion of the earring member is avoided, such slotting normally detracting from the ornamental appearance of the earring. Further, the pivot portion of the earwire as defined by the legs 24, 28 and the pivot leg 26 cooperate with the piercing portion 30 and finger 32 to define an ornamentally and attractive arrangement; and since the pivot portion of the earwire constitutes an integral part thereof, a sturdy construction is defined that will prevent the earwire from being sheared from the assembled position thereof.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A pierced earring construction, comprising an earring member including a body portion that terminates in spaced free ends, a laterally extending opening formed in said body portion adjacent to one of the free ends thereof, and an earwire including a pivot portion formed as an integral part thereof that is mounted in said opening for pivotally locating said earwire on said body portion, a piercing portion of said earwire joined to the pivot portion thereof and bridging the space between said free ends for mounting the earring member on an ear of a wearer, said pivot portion of said earwire including a pivot leg that extends through said opening and that is located in substantially perpendicular relation with respect to the piercing portion to which said pivot portion is joined, said pivot portion including means for coacting with adjacent surfaces of said body portion to prevent undue lateral shifting of said earwire relative to said body portion during pivoting, said means comprising other legs that are joined to said pivot leg and that cooperate therewith to define a triangular configuration, said other legs being located in close proximity to said surfaces of said body portion on opposite sides thereof.

2. A pierced earring construction as claimed in claim 1, the piercing portion of said earwire that bridges the space between the free ends of said earring being located in alignment with the body portion, an end finger being joined to said piercing portion and being receivable in the free end of said body portion that is opposite to the free end to which said pivot portion is pivotally connected.

* * * * *